US007941909B2

(12) United States Patent
Miyashita et al.

(10) Patent No.: US 7,941,909 B2
(45) Date of Patent: May 17, 2011

(54) METHOD OF FABRICATING AN ULTRA-SMALL CONDENSER MICROPHONE

(75) Inventors: Yoshiyuki Miyashita, Niigata (JP); Naoki Takahashi, Niigata (JP); Takashi Yamamoto, Niigata (JP); Shinichi Ichikawa, Niigata (JP)

(73) Assignee: Panasonic Corporation, Osaka (JP)

( * ) Notice: Subject to any disclaimer, the term of this patent is extended or adjusted under 35 U.S.C. 154(b) by 14 days.

(21) Appl. No.: 12/265,453

(22) Filed: Nov. 5, 2008

(65) Prior Publication Data

US 2009/0119905 A1 May 14, 2009

(30) Foreign Application Priority Data

Nov. 14, 2007 (JP) ..... 2007-295574

(51) Int. Cl.

| | |
|---|---|
| ***H04R 31/00*** | (2006.01) |
| ***H01R 43/00*** | (2006.01) |
| ***H04R 25/00*** | (2006.01) |
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |

(52) U.S. Cl. ..... 29/594; 29/825; 381/150; 381/369

(58) Field of Classification Search ..... 29/594, 29/825; 381/150, 369
See application file for complete search history.

(56) References Cited

U.S. PATENT DOCUMENTS 7,080,442 B2 * 7/2006 Kawamura et al. ..... 29/594
2007/0274544 A1 11/2007 Takeuchi et al.

FOREIGN PATENT DOCUMENTS

JP 2007-294858 11/2007
JP 2008-112755 * 5/2008

* cited by examiner

*Primary Examiner* — A. Dexter Tugbang
*Assistant Examiner* — David P Angwin
(74) *Attorney, Agent, or Firm* — McDermott Will & Emery LLP

(57) ABSTRACT

In the present invention, a plurality of condenser microphones is formed on a substrate. Then, charges are fixed to a dielectric film provided in each of the condenser microphones. After an amount of deposited charges of the dielectric film of each of the plurality of the condenser microphones is inspected by measuring capacitance of each condenser microphone while applying bias between the first electrode film thereof and the second electrode film thereof, the substrate is diced so that each of the condenser microphones is separated. Thus, at least the step of fixing charges is performed in a substrate state where the plurality of the condenser microphones is formed on the substrate. Therefore, the present invention contributes to enhancement of productivity in an assembly process of the condenser microphone and reduction in equipment costs.

9 Claims, 4 Drawing Sheets

METHOD OF FABRICATING AN ULTRA-SMALL CONDENSER MICROPHONE

CROSS-REFERENCE TO RELATED APPLICATION

The present application claims the benefit of patent application number 2007-295574, filed in Japan on Nov. 14, 2007, the subject matter of which is incorporated herein by reference.

BACKGROUND OF THE INVENTION

1. Field of the Invention

The present invention relates to a method of fabricating an ultra-small condenser microphone using a semiconductor process technology.

2. Description of the Related Art

An electret condenser microphone (ECM) is an acousto-electric transducer wherein an electret film having a semi-permanent electric polarity is formed by electretizing, and a DC (direct current) bias voltage is not needed to be applied to both electrodes of a condenser. An electret film is formed by electrically charging a dielectric film and fixing charges in the dielectric film so that a potential difference is generated between both electrodes by an electric field occurred by the fixed charges. Hereinafter, to fix charges in the dielectric film is referred to as 'electretization' and an amount of fixed charges is referred to as 'an amount of deposited charges'.

In recent years, ultra-small condenser microphones have been fabricated by processing silicon substrates utilizing a micro-processing technology for semiconductor integrated circuits. Such ultra-small condenser microphones have received attention as micro-electro-mechanical system (MEMS) microphones (hereinafter referred to as MEMS microphones). MEMS microphones are incorporatedly formed on a silicon substrate using a semiconductor process technology, so that it is impossible that a dielectric film alone is taken out from the microphones and separately electretized. The Japanese Patent Laid-Open Publication No. 2007-294858 discloses that a dielectric film is electretized in a state that a MEMS microphone chip formed by micro-processing a silicon wafer is mounted on a substrate for packaging or in a state of an individual MEMS microphone chip which is separated by cutting a semiconductor substrate. In this technology, a dielectric film provided in a MEMS microphone chip is electretized by applying a corona discharge at least a time to a single or several MEMS microphone chips simultaneously by a needle electrode or a wire electrode.

A conventional assembly flow of a MEMS microphone will be discussed referring to FIG. 5 as follows. First, in a wafer fabrication step S101, a wafer whereon many MEMS microphone chips are incorporatedly formed is formed utilizing a semiconductor process technology. The wafer completed the wafer fabrication step moves forward to an assembly step. In the assembly step, firstly, the wafer is stuck on an adhesive sheet fixed to a ring frame with tension in a sticking sheet step S102. Next, in a probe inspection step S103, an electrical property is measured by contacting probe needles for measurement with each MES microphone formed on the wafer in a state that the wafer is stuck on the adhesive sheet. Based on the result of the measurement, non-defective chips at the conclusion of the wafer fabrication step S101 are screened.

Successively, in a dicing step S104, a wafer is separated (diced) into individual MEMS microphone chips. After that, in an UV irradiation/pick-up step S105, adhesion of the adhesive sheet is reduced through UV (ultraviolet) light irradiation, and then a MEMS microphone chip distinguished as a non-defective in the probe inspection step S103 is picked up one by one and loaded onto a tray.

The MEMS microphone chip loaded onto the tray is transferred and held one by one at an electretization processing position in a step S106 of an electretization/inspection for amount of deposited charges. In this state, a MEMS microphone chip is electretized and the electretized chip is transferred and held to a processing position of an inspection apparatus wherein the amount of deposited charges is inspected. In this state, the amount of deposited charges in an electret film is inspected whether or not a predetermined amount of charges is deposited. Based on a result of the inspection, MEMS microphone chips are classified by a defective or a non-defective and loaded onto a metal tray respectively. The individual MEMS microphone chip classified as the non-defective is heat-treated in a state that the chip is placed on the metal tray in an annealing step S107. After that, the MEMS microphone chip completed the heat treatment is transferred from the metal tray one by one to a mounting position on a substrate for packaging and bonded thereon in a dice bonding step S108. Finally, in a modularization step S109, a wire bonding between the mounted MEMS microphone chip and the substrate for packaging is performed, and then a metal cap is put on.

As discussed above, in from the UV irradiation/pick-up step S105 to the dice bonding step S108 in the assembly process shown in FIG. 5, the diced MEMS microphone chip is transferred in a state where it is loaded on the tray from one processing step to another and is transferred and processed in a production equipment used in each processing step.

SUMMARY OF THE INVENTION

In fabricating a MEMS microphone using a semiconductor process technology as discussed above, a dielectric film composing a condenser is electretized in a state that a MEMS microphone chip is mounted on the substrate for packaging or in a state of an individual MEMS microphone chip. As a result, the assembly step contains many steps of transferring and processing in a state that the chip is mounted on the substrate for packaging or in a state of being diced. Since a MEMS microphone chip has a hollow portion having a thin layer as one of walls, a structure of a chip is extremely fragile. Thus, a limited portion of the chip is allowed to absorb for transferring and to grip for mounting to the substrate for packaging. In order to absorb or grip the limited supporting portion, an accuracy to recognize a position of the chip which is an object to be supported has to be improved using an image recognition and the like so as not to occur a positioning error, and a stress added to the chip for supporting have to be strictly controlled within an extremely narrow range. Therefore, the production equipment for processing the chip is getting complicated and it is difficult to increase productivity. Besides, the equipment cost will be higher.

The present invention is suggested in consideration of the above discussed problems and has an object to provide a fabricating method of an ultra-small condenser microphone lowering an equipment cost and enhancing productivity of an assembly step of an ultra-small condenser microphone.

The present invention employs following technical methods in order to solve the above-discussed problems and accomplish the objects. Firstly, the present invention is assumed that a method of fabricating an ultra-small condenser microphone includes a first electrode film formed on a substrate, a dielectric film formed on the first electrode and a second electrode film formed above the dielectric film via a hollow part, and the substrate under the first electrode is formed by removing the substrate except for a portion thereof corresponding to the periphery of the first electrode. In a method of fabricating the ultra-small condenser microphone according to the present invention, a plurality of the ultra-small condenser microphones is formed on a same substrate. Next, charges are fixed to each dielectric film provided in each ultra-small condenser microphone formed on the same substrate. After inspecting an amount of deposited charges of each dielectric film, the substrate whereon the plurality of the ultra-small condenser microphones is formed is diced so as to separate each ultra-small condenser microphone. In the present invention, at least the above-described step of fixing charges to each dielectric film is performed in a substrate state where the plurality of the ultra-small condenser microphones is formed on the same substrate.

An annealing step may be performed to each ultra-small condenser microphone in the substrate state after the step of fixing charges to each dielectric film is performed in the method of fabricating the ultra-small condenser microphone. Further, the step of inspecting the amount of deposited charges of each dielectric film can be performed in the substrate state. Furthermore, the method of fabricating the ultra-small condenser microphone may include a step of dice bonding each separated ultra-small condenser microphone to a substrate for packaging.

The present invention has a structure that ultra-small condenser microphones are successively fabricated for each wafer as transferring and processing are performed in the substrate state, thereby enhancing productivity. Further, equipment costs will be reduced by restraining complication of the equipments.

The foregoing and other objects, features, aspects and advantages of the present invention will become more apparent from the following detailed description of the present invention when taken in conjunction with the accompanying drawings.

DETAILED DESCRIPTION OF PREFERRED EMBODIMENTS

An embodiment of the present invention will be described in detail hereinafter with reference to the drawings. In a fabricating method of an ultra-small condenser microphone (a MEMS microphone) in accordance with the present invention, the steps of an electretization/inspection for an amount of deposited charges and annealing are processed in a wafer state so as to successively process in a wafer state just before a step of dice bonding to a substrate for packaging, thereby enhancing productivity.

Figure 1:
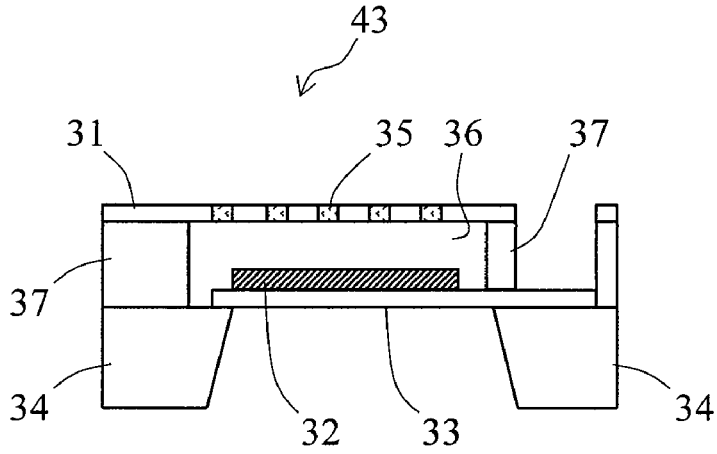
FIG. 1 is a cross-sectional view showing a MEMS microphone chip.

FIG. 1 is a cross-sectional view showing a structure of a MEMS microphone chip fabricated by processing a silicon wafer using a semiconductor process technology. As shown in FIG. 1, a MEMS microphone chip 43 has a base 34 made of a silicon wafer (silicon diaphragm) having an opening in the center part. The opening in the base 34 is blocked by a vibration film 33. An inorganic dielectric film 32 which is an object to be electretized is formed on an opposite surface of the base 34 of the vibration film 33. A fixed electrode 31 supported by a spacer 37 is arranged to be opposed to the inorganic dielectric film 32. The fixed electrode 31 has a plurality of acoustic holes 35 (openings for transmitting an acoustic wave to the vibration film 33). An air gap 36 is provided between the inorganic dielectric film 32 and the fixed electrode 31. The air gap 36 is formed by etching and removing a sacrificial layer embedded that area in a wafer fabrication process of the silicon wafer. In this structure, the vibration film 33 functions as one of electrodes of a condenser and the fixed electrode 31 functions as the other one of electrodes of the condenser. The silicon wafer supports only the periphery portion of the vibration film 33 and the surface of the vibration film 33 is exposed from the opening of the silicon wafer.

Figure 2:
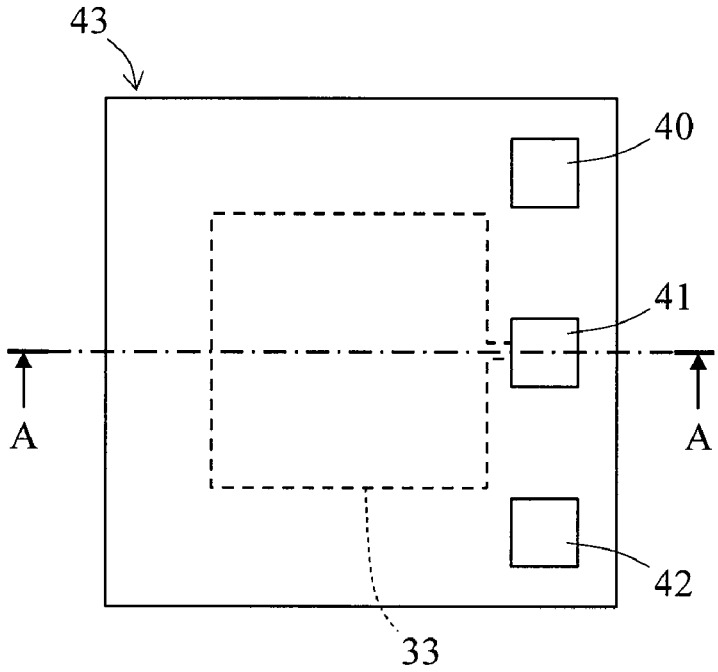
FIG. 2 is a plan view showing a MEMS microphone chip.

FIG. 2 is a plan view showing the MEMS microphone chip 43 in FIG. 1. FIG. 1 is a cross-sectional view taken along A-A line in FIG. 2. As shown in FIG. 2, electrode pads 40, 41 and 42 are formed on the surface having the inorganic dielectric film 32 of the base 34. The pad 40 is electrically connected to the fixed electrode 31 (not shown). The pad 41 is connected to the vibration film 33 by an interconnection passed through the spacer 37, and the pad 42 is electrically connected to the silicon wafer 34. The pads 40, 41 and 42 are utilized to make contact with probe pins in inspections and are utilized for wire bonding in assembling.

Referring to FIGS. 1 and 2, it is recognized that the MEMS microphone chip 43 is a compound body having the frame-shaped base 34, the air gap 36, the fixed electrode 31 composed of a thin film and the vibration film 33 comprised of a thin film. Thus, the MEMS microphone chip 43 is extremely apt to be damaged by outer stress. Therefore, production equipments conventionally utilized in an assembly step has to be provided with a delicate and complicated mechanism in order to transfer and hold a MEMS microphone chip having an extremely weak structure and the production equipment is expensive. Further, the conventional production equipments are slow in processing due to having difficulty in transferring in high-speed and is trouble-prone so that enormous man-hour is needed for maintenance and preservation.

Figure 3:
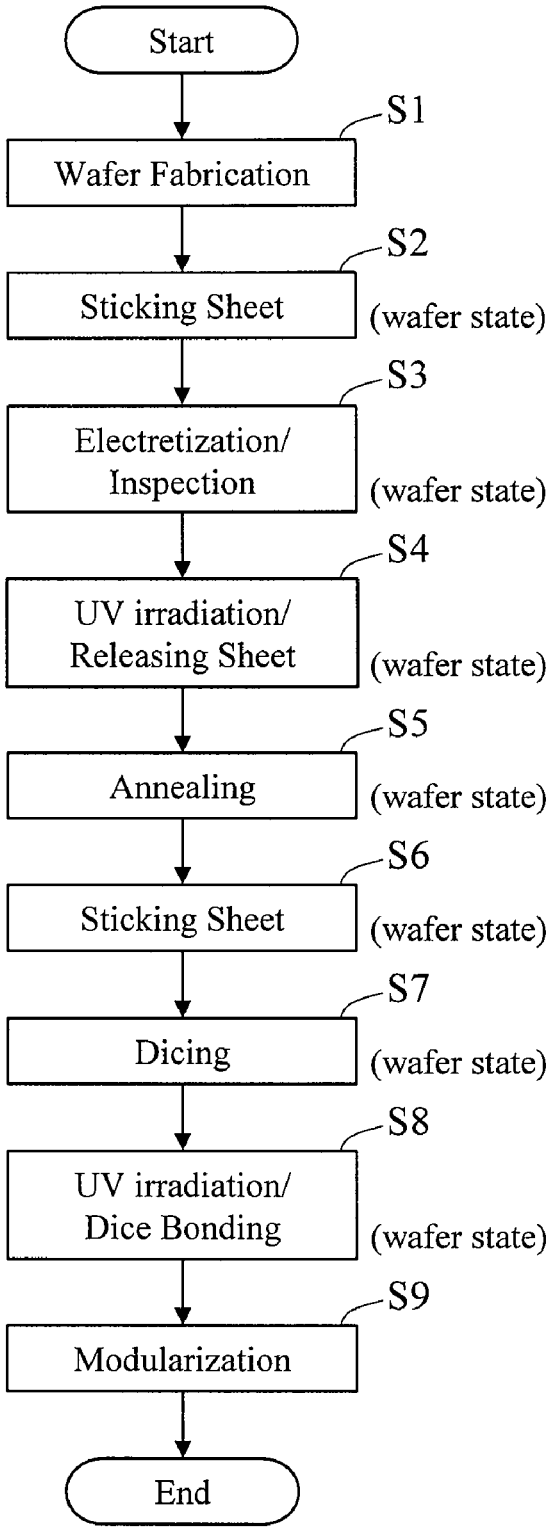
FIG. 3 is a flow chart showing an assembly flow of a MEMS microphone that relates to an embodiment of the present invention.

FIG. 3 is a flow chart showing assembly steps of a MEMS microphone in accordance with the present embodiment. First, a plurality of MEMS microphone chips is formed using a semiconductor process technology on a wafer (a silicon substrate) in a wafer fabrication step S1. After completion of the wafer fabrication step S1, the wafer whereon the MEMS microphone chips are formed is stuck on an adhesive sheet fixed to a ring frame with tension in a sticking sheet step S2. Here, the wafer is stuck in a state that the surface of the silicon substrate 34 side shown in FIG. 1 contacts the adhesive sheet. Therefore, in a step of an electretization/inspection for amount of deposited charges performed thereafter, when the wafer is absorbed and held on a stage of a wafer prober to perform the electretization and the inspection of the amount of deposited charges, damages of the vibration film 33 and the like can be prevented. Note that the adhesive sheet has adhesion on only one side and the adhesion can be reduced by irradiating ultraviolet light thereto.

In a step S3 of an electretization/inspection for amount of deposited charges, the back surface of the adhesive sheet whereon a wafer is not stuck is absorbed and held. The inorganic dielectric film 32 is electretized in this state.

Figure 4:
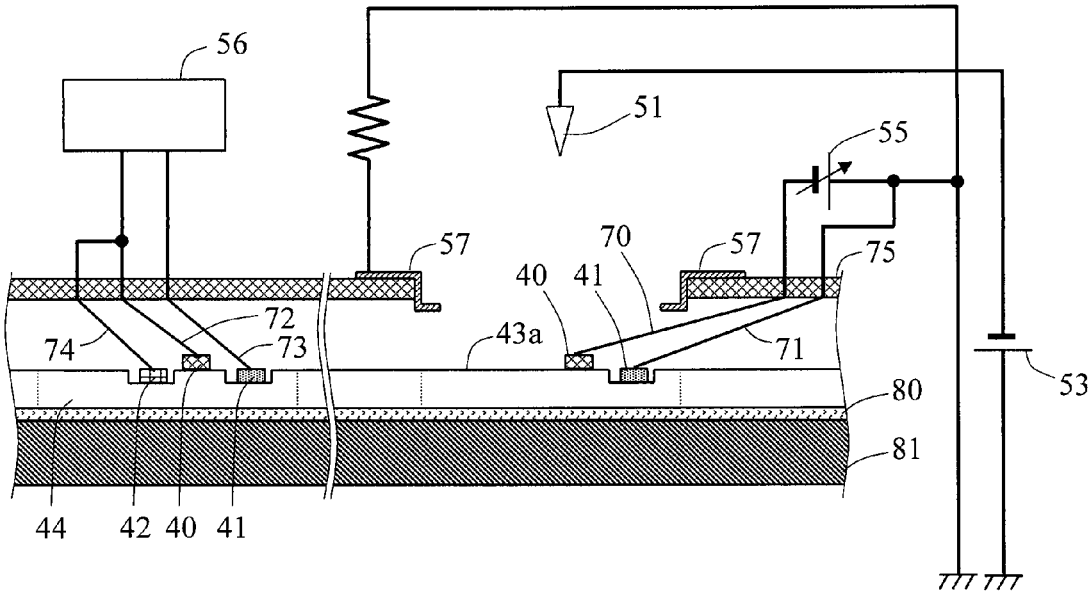
FIG. 4 is a cross-sectional view showing a principal part of an electretization apparatus that relates to an embodiment of the present invention.

FIG. 4 is a schematic cross-sectional view showing a principal part of a structure of a wafer prober used in this step. As shown in FIG. 4, the wafer prober has a stage 81 whereon a wafer stuck on an adhesive sheet 80 is disposed. In an opposite position to the stage 81, a needle electrode 51 is arranged. A high voltage power source 53 is connected to the needle electrode 51 so as to cause a corona discharge. A probe card 75 having probe pins 70 and 71 which are arranged according to an arrangement of pads 40 and 41 formed on the MEMS microphone chip 43 is fixed between the stage 81 and the needle electrode 51. The probe pin 71 is connected to a ground potential. The probe pins 70 and 71 are connected to a variable voltage power source 55 which gives a potential difference between the probe pins 70 and 71. The probe card 75 has probe pins 72, 73 and 74 arranged corresponding to the positions of pads 40, 41 and 42 provided on the MEMS microphone chip 44 which has been already electretized on the same wafer. The probe pins 72, 73 and 74 are connected to an inspection apparatus 56 that measures an amount of deposited charges.

When the electretization and the inspection of the amount of deposited charges are performed by using the above described wafer prober, a wafer stuck to the adhesive sheet 80 is disposed and held on the stage 81. Then, the stage 81 moves horizontally so that a first MEMS microphone chip 43*a* to be electretized locates directly below the needle electrode 51. Thereafter, the stage 81 rises so that the probe pins 70 and 71 contact the pads 40 and 41 of the MEMS microphone chip 43*a* to be electretized.

When the probe pins 70 and 71 contact the pads 40 and 41, the variable voltage power source 55 applies a voltage to give a potential difference between probe pins 70 and 71. As described above, the pad 40 in contact with the probe pin 70 is electrically connected to the fixed electrode 31 (see FIG. 1) and the pad 41 in contact with the probe pin 71 is electrically connected to the vibration film 33 (see FIG. 1), thereby the variable voltage power source 55 gives the potential difference between the fixed electrode 31 and the vibration film 33.

In such a state, the high voltage power source 53 applies a voltage to the needle electrode 51, thereby causing a corona discharge thereto. In the wafer prober shown in FIG. 4, a negative potential is applied to the needle electrode 51 and the fixed electrode 31 and a ground potential is applied to the vibration film 33. Thus, the inorganic dielectric film 32 is irradiated with negative ions resulting from the corona discharge through an opening of the probe card 75 and the acoustic holes 35 (see FIG. 1) provided in the fixed electrode 31 in the MEMS microphone chip 43*a* to be electretized. As the electretization of the inorganic dielectric film 32 develops, the potential difference between the fixed electrode 31 and the inorganic dielectric film 32 decreases. When the potential difference between the fixed electrode 31 and the inorganic dielectric film 32 comes to zero in the end, negative ions resulting from the corona discharge do not reach the inorganic dielectric film 32. In this manner, the inorganic dielectric film 32 in the MEMS microphone chip 43*a* is electretized by negative ions. Note that a cover 57 connected to the ground potential through relatively high resistance body is arranged in the opening of the probe card 75. The cover 57 shields a path of ions moving to MEMS microphone chips adjacent to the MEMS microphone chip 43*a* on the wafer.

When the electretization of the inorganic dielectric film 32 is completed after enough time is passed to deposit the desired amount of charges, the stage 81 goes down and moves horizontally so that a MEMS microphone chip adjacent to the MEMS microphone chip completed the electretization on the wafer locates directly below the needle electrode 51. Then, the stage 81 goes up and the MEMS microphone chip is electretized using the above-discussed manner.

In the wafer prober shown in FIG. 4, when the probe pins 70 and 71 contact the pads 40 and 41 on the MEMS microphone chip 43*a* to be electretized, each of the probe pins 72, 73 and 74 contacts each of other pads 40, 41 and 42 on the MEMS microphone chip 44. Thus, the probe pin 72 is connected to the fixed electrode 31 in the MEMS microphone chip 44, the probe pin 73 is connected to the vibration film 33 in the MEMS microphone chip 44 and the probe pin 74 is connected to the base (silicon substrate) 34 in the MEMS microphone chip 44, respectively. Therefore, the inspection apparatus 56 that measures the amount of deposited charges can successively inspect the amount of charges deposited in the MEMS microphone chip 44 which is completed the electretization in the same wafer in parallel with the electretization of the MEMS microphone chip 43*a* to be electretized.

Successively, the back surface of the adhesive sheet is irradiated with UV light in an UV irradiation/releasing sheet step S4. Thereby, the adhesion of the adhesive sheet is weakened and the wafer is released from the adhesive sheet. The released wafer is annealed at a temperature of approximately 200° C. in a annealing step S5. The annealing process strengthens the electretization in the inorganic dielectric film 32 and removes charges from portions except for the inorganic dielectric film 32.

In the second sticking sheet step S6, the wafer is stuck on an adhesive sheet supported by a ring as in the above-described sticking sheet step S2. The stuck wafer is diced into individual MEMS microphone chips in a dicing step S7.

Next, in a UV irradiation/dice bonding step S8, UV irradiation is performed on the surface of the adhesive sheet which is an opposite surface of the MEMS microphone chip so as to weaken adhesion of the sheet and only non-defective diced chips determined as non-defectives in the electretization/inspection step S3 are transferred from the adhesive sheet on the ring to a mounting position on a substrate for packaging and bonded thereon. In this step, a CMOS-Amp chip amplifying signals outputted from the diced MEMS microphone chip as well is bonded on the substrate for packaging in the same manner as the diced MEMS microphone chip. Here, the CMOS-Amp chip is a semiconductor chip wherein an amplifier circuit is formed using a CMOS (Complementary Metal Oxide Semiconductor) process.

Next, in a modularization step S9, wire bonding between the diced MEMS microphone chip bonded on the substrate for packaging and the substrate for packaging, wire bonding between the COMS-Amp chip bonded on the substrate for packaging and the substrate for packaging, and wire bonding between the diced MEMS microphone chip and the COMS-Amp chip are performed, and then a metal cap to seal is put on.

As discussed above, in the assembly process of the MEMS microphone chip according to the present invention, the step of the electretization/inspection for amount of deposited charges and the annealing step can be performed in a wafer state in contrast to the conventional steps. Also, a step wherein a single diced MEMS microphone chip is processed is only once in the UV irradiation/dice bonding step S8 wherein a diced MEMS microphone chip is picked-up and transferred to the substrate for packaging, and then the diced MEMS microphone chips are successively processed in a wafer state where the chips are held together by the adhesive sheet in from the steps S2 to S7. Therefore, it is not necessary to transfer the diced MEMS microphone chips, which are hollow and fragile due to the dicing, in a state that the chips are loaded on a tray from one processing step to another.

Although a defective or a non-defective is determined by measuring capacitance between the fixed electrode 31 and the vibration film 33 in the probe inspection step S103 in the conventional assembly process, bias is applied between the fixed electrode 31 and the vibration film 33 to measure the capacitance so that the amount of deposited charges can be obtained by calculating using the measured capacitance in the step S3 of the electretization/inspection for amount of deposited charges in the present invention. Namely, in the present invention, an advantage of removing the probe inspection step is obtained by performing the measurement of the capacitance and the inspection of the amount of deposited charges.

Figure 5:
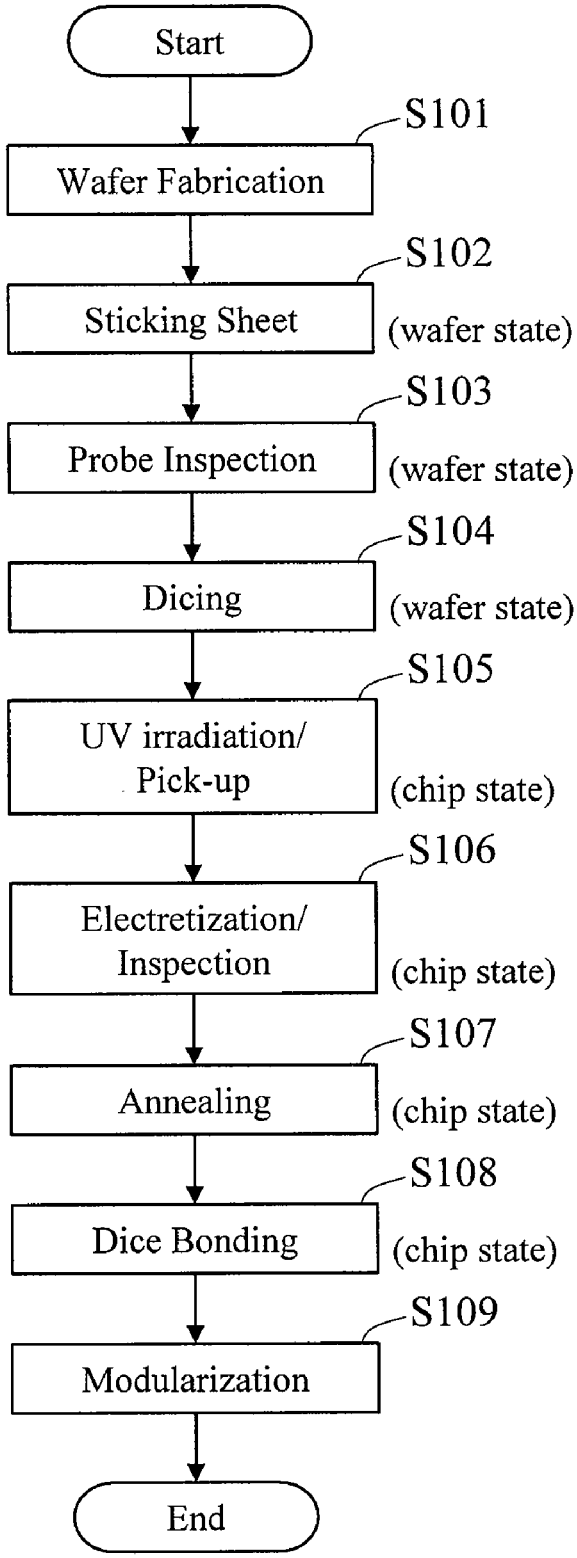
Fig. 5 (PRIOR ART)
FIG. 5 is a flow chart showing a conventional assembly flow of a MEMS microphone.

Here, comparison between the assembly process in the present invention and the conventional assembly process is discussed as follows. In the conventional assembly flow shown in FIG. 5, a process of that a diced MEMS microphone chip is transferred from an adhesive sheet to a tray in a UV irradiation/pick-up step S105 is performed, thereafter a process of that the diced chip is transferred and held to an electretization apparatus after the tray is transferred to the electretization apparatus is performed, and next a process of that the diced chip is transferred and held to an inspection apparatus which measures an amount of deposited charges is performed. Further, a process of that the diced MEMS microphone chip is picked up from the inspection apparatus and is transferred to a metal tray is performed, thereafter a process of that the metal tray is transferred to an anneal apparatus is performed, and next a process of that the diced chip is transferred to a dice bonding apparatus after the metal tray is transferred from the annealing apparatus to the dice bonding apparatus after annealing is performed. Namely, in the conventional assembly process, the diced MEMS microphone chip is transferred five times and the diced chip on the metal tray is transferred three times. On the contrary, in the present invention, the diced chip is transferred only once and the diced chip on the metal tray is never transferred.

In transferring the diced MEMS microphone chip between each of the assembly apparatuses, the periphery portion of the chip above the spacer 37 in the fixed electrode 31 in FIG. 1 should be absorbed by a collet because the chip is damaged if the portion above the air gap 36 of the fixed electrode 31 is absorbed. Therefore, positioning accuracy of the collet is needed to be improved using such as image recognition in order to prevent positioning errors in the absorption process. Further, although the thickest portion on the side surface of the base 34 is needed to be griped to hold the diced chip at the processing position of the assembly apparatus, chuck-positioning accuracy and stress management is required as the base 34 has no strength against stress. Thus, an expensive mechanism is required and much time is required for a process of holding in the conventional assembly process. In the assembly process of the present invention, great reduction of equipment costs and enhancement of productivity are accomplished since the number of times the diced chip is transferred and held are greatly reduced and additionally transferring the dice on the tray is eliminated.

The embodiment as discussed above do not restrict the technical range of the present invention and various modifications and applications can be available within the effective range of the present invention besides the embodiment as discussed above. For example, although electretization and inspection of an amount of deposited charges are performed in parallel in the embodiment as discussed above, these can be performed respectively. Further, although a dielectric film to be electretized is an inorganic dielectric film in the above, an organic dielectric film as well is applicable to the present invention.

The present invention has an effect of enhancement of productivity and reduction in equipment costs in the assembly process of MEMS microphones using fine process technology of silicon, and is useful as fabricating method of an ultra-small condenser microphone such as micro-miniature sized MEMS microphones equipped in mobile communication devices.

What is claimed is:

1. A method of fabricating a condenser microphone, comprising the steps of:

(a) forming a plurality of condenser microphones on a substrate, each of the condenser microphones including a first electrode film formed on the substrate, a dielectric film formed on the first electrode film and a second electrode film formed above the dielectric film, the substrate is formed under a periphery portion of the first electrode film and includes an opening under the dielectric film;

(b) fixing charges to the dielectric film of each of the plurality of the condenser microphones formed in the step (a);

(c) inspecting an amount of deposited charges of the dielectric film of each of the plurality of the condenser microphones by measuring capacitance of each condenser microphone while applying bias between the first electrode film thereof and the second electrode film thereof; and (d) dicing the substrate whereon the plurality of the condenser microphones is formed and separating each condenser microphone, wherein at least the step (b) is performed in a substrate state where the plurality of the condenser microphones is formed on the substrate,

2. A method according to of claim 1, further comprising the step of:

(e) annealing each condenser microphone in the substrate state after the step (b) is performed.

3. A method according to claim 1, wherein the step (c) is performed in the substrate state.

4. A method according to claim 2, wherein the step (c) is performed in the substrate state.

5. A method according to claim 1, further comprising the step of:

(f) dice bonding each condenser microphone separated in the step (d) to a mounting board for packaging.

6. A method according to claim 2, further comprising the step of:

(f) dice bonding each condenser microphone separated in the step (d) to a mounting board for packaging.

7. A method according to claim, 3, further comprising the step of:

(f) dice bonding each condenser microphone separated in the step (d) to a mounting board for packaging.

8. A method according to claim 1, wherein the step (b) for one of the condenser microphones on the substrate and the step (c) for another of the condenser microphones completed the step (b) on the substrate are simultaneously performed.

9. A method according to claim 1, further comprising the step of:

classifying the plurality of the condenser microphones into a first group and a second group based on an inspection result in the step (c), and wherein each condenser microphone in the first group is bonded to a mounting board for packaging and each condenser microphone in the second group is not bonded to the mounting board for packaging.

* * * * *